US006776629B2

(12) United States Patent
Shuey

(10) Patent No.: US 6,776,629 B2
(45) Date of Patent: Aug. 17, 2004

(54) CONNECTOR FOR MOUNTING TO MATING CONNECTOR, AND SHIELD THEREFOR

(75) Inventor: Joseph B. Shuey, Camp Hill, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/170,731

(22) Filed: Jun. 13, 2002

(65) Prior Publication Data

US 2003/0232527 A1 Dec. 18, 2003

(51) Int. Cl.[7] ..... H01R 4/66; H01R 13/648
(52) U.S. Cl. ..... 439/108; 439/607; 439/608
(58) Field of Search ..... 439/607, 608, 439/108

(56) References Cited

U.S. PATENT DOCUMENTS 5,104,341 A * 4/1992 Gilissen et al. ..... 439/608
5,496,183 A * 3/1996 Soes et al. ..... 439/607
5,664,968 A * 9/1997 Mickievicz ..... 439/608
5,795,191 A * 8/1998 Preputnick et al. ..... 439/608
6,461,202 B2 * 10/2002 Kline ..... 439/701

* cited by examiner

*Primary Examiner*—P. Austin Bradley
*Assistant Examiner*—Briggitte R. Hammond
(74) *Attorney, Agent, or Firm*—Woodcock Washburn LLP

(57) ABSTRACT

A connector mates to a header having a plurality of header contacts arranged into a plurality of header rows, where the header contacts in each header row include signal contacts and ground contacts in a pre-determined arrangement. The connector is complementary to the header and has a housing and a connector row corresponding to each header row. Each connector row is mounted as a sub-assembly to the housing to form the connector and has a plurality of connector contacts, a row block, and a row shield. Each connector contact of the connector row corresponds to a header contact. The row block securely holds each connector contact in the connector row. The row shield electrically shields the connector contacts of the connector row from an adjacent connector row.

7 Claims, 5 Drawing Sheets

CONNECTOR FOR MOUNTING TO MATING CONNECTOR, AND SHIELD THEREFOR

FIELD OF THE INVENTION

The present invention relates to a connector assembly for being coupled to a mating connector, and a shield for such connector. In particular, the present invention relates to such a connector with a vertical shield between rows of connector contacts.

BACKGROUND OF THE INVENTION

In a typical electrical interconnection system, a first removably insertable circuit board includes a complementary electrical connector that is to be mated with a header assembly or header which is mounted to a second circuit board. As should be understood, when the first circuit board is coupled to the second circuit board by way of the electrical connector and header and when the first circuit board is in operation, a number of signals enter or leave the first circuit board through conductive paths defined by the electrical connector on the first circuit board and the header on the second circuit board. In many instances, the second circuit board has other circuit boards coupled thereto by other respective headers and complementary electrical connectors, and the aforementioned signals can originate from or be destined for such other circuit boards. Of course, the aforementioned signals can also originate from or be destined for other locations remote from the second circuit board by way of appropriate interconnections.

In any connector-header coupling, and especially in any coupling involving high speed, it is desirable to suppress signal noise and/or cross-talk.

In one conventional noise suppression arrangement, a signal is transmitted over a pair of differential (positive and negative) signal lines that travel together in close proximity. Typically, in such pair of differential lines, the signal itself (+V) is transmitted on the positive line, and the negation of the signal (−V) is transmitted on the negative line. Since both lines travel together in close proximity, any noise encountered by the lines should appear in a generally identical form on both lines. Accordingly, the subtraction (by appropriate circuitry or other means) of the negative line (−V+noise) from the positive line (+V+noise) should cancel out such noise ((+V+noise)−(−V+noise)=2V), thus leaving the original signal, perhaps with a different amplitude.

Though successful, the differential pair noise suppression arrangement nevertheless can require assistance, especially in a high frequency environment and where multiple signals pass through a connector in relatively close proximity (i.e., in high density). To combat such density-based noise, the connector requires shielding which substantially electromagnetically isolates within the connector each pair of differential signal lines from every other pair of differential signal lines.

Accordingly, a need exists for a connector that can have signals such as multiple differential signal pairs in relatively high density, and that has shielding for the signal pins, where the connector is practical and relatively easily manufactured.

SUMMARY OF THE INVENTION

The present invention satisfies the aforementioned need by providing a connector for being mated to a header having a plurality of header contacts arranged into a plurality of header rows, where the header contacts in each header row include signal contacts and ground contacts in a predetermined arrangement. The connector is complementary to the header and has a housing and a connector row corresponding to each header row.

Each connector row is constructed as a subassembly that is mounted to the housing to form the connector, and has a plurality of connector contacts, a row block, and a row shield. Each connector contact of the connector row corresponds to a header contact. The row block securely holds each connector contact in the connector row. The row shield electrically shields the connector contacts of the connector row from an adjacent connector row.

BRIEF DESCRIPTION OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
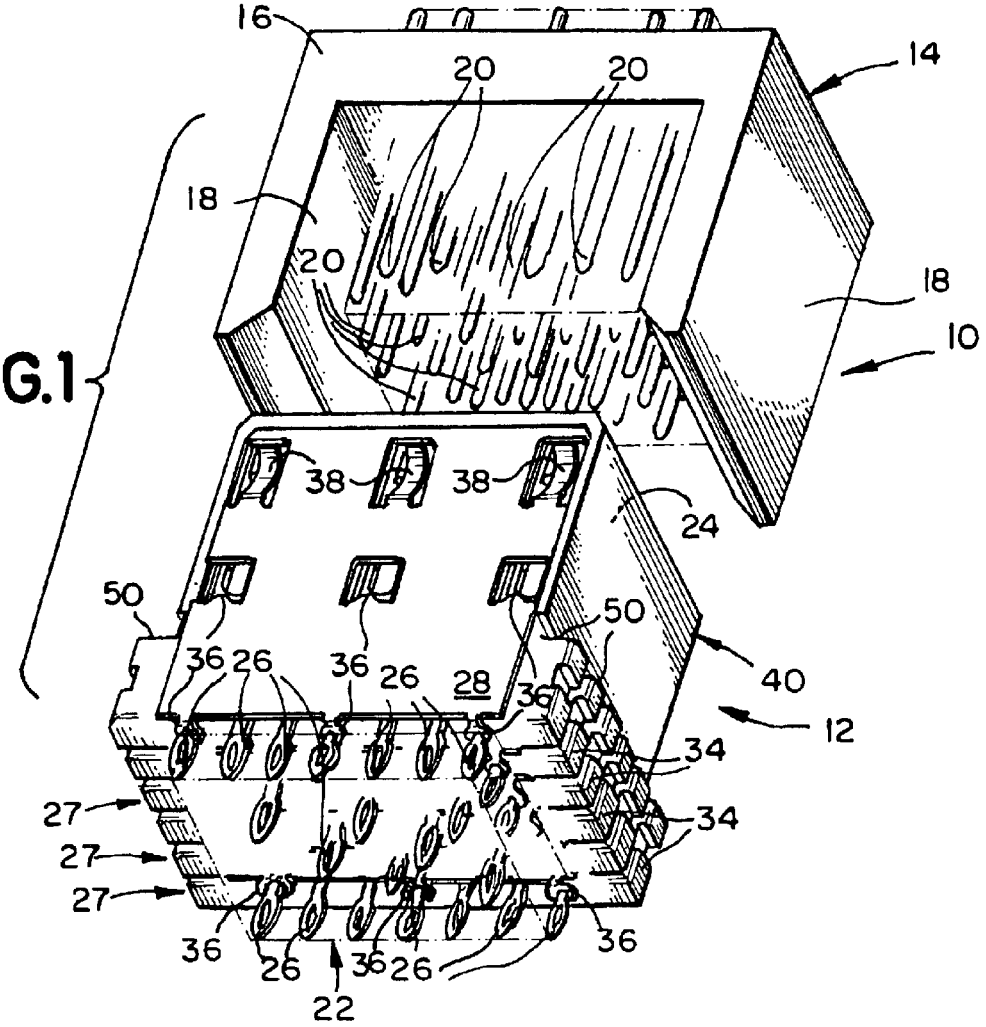
FIG. 1 is a perspective view of a header module and a connector for mounting to the header module in accordance with one embodiment of the present invention, with various of the contacts of each omitted for the sake of clarity.
Figure 2A:
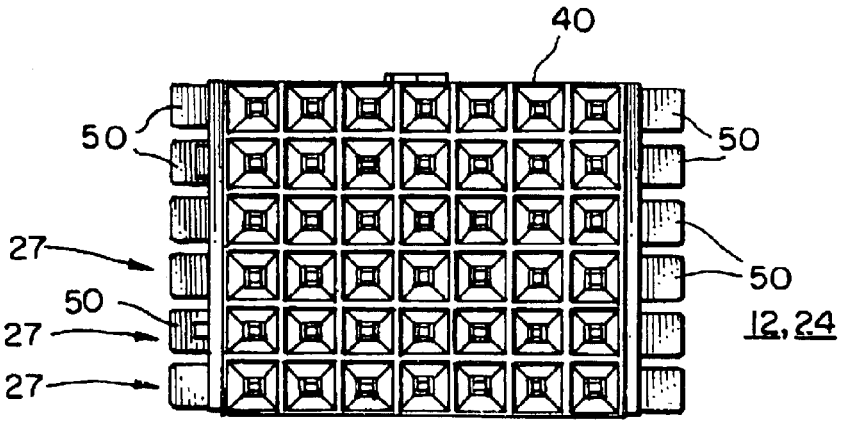
FIGS. 2A–2D are top plan, front plan, right side plan, and bottom plan views, respectively, of the connector of FIG. 1 in accordance with one embodiment of the present invention.
Figure 2B:
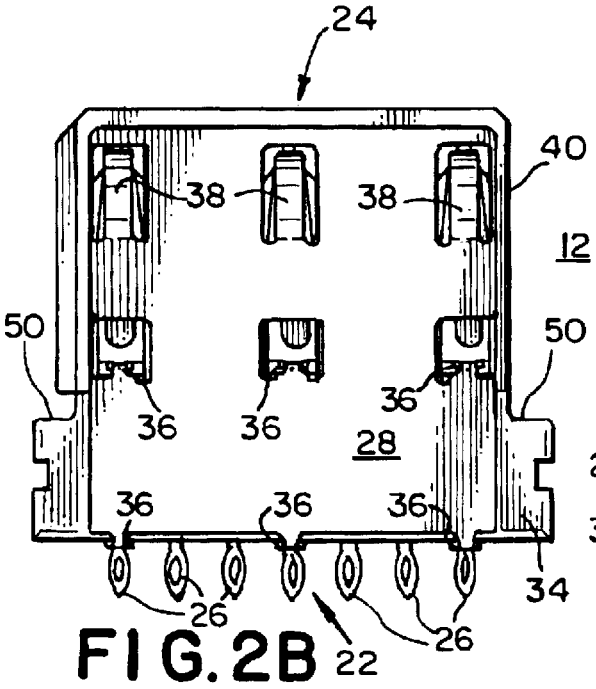
Figure 2C:
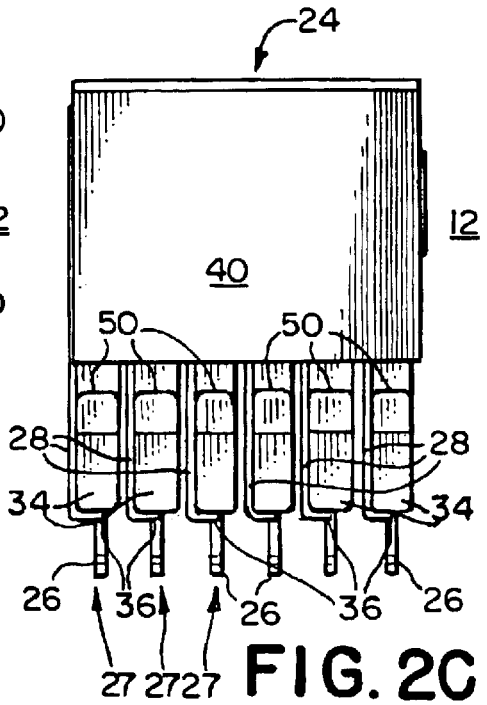
Figure 2D:
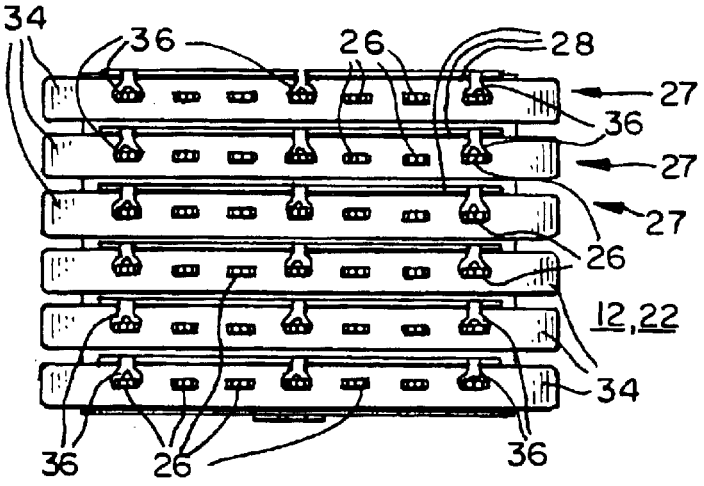

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIG. 1 a typical header 10 for a parallel board application or the like. The header 10 is for being mounted to a circuit substrate such as a first circuit board (not shown) in a position to receive a complementary electrical connector 12 such as that of the present invention on another circuit substrate such as a second circuit board (not shown) that is to be coupled to the first circuit board by way of the electrical connector and header 10 in a generally parallel manner.

As seen, the header 10 includes an insulating shroud 14 which has a base 16. As should be understood, when the header 10 is mounted to a substrate, the base 16 of the shroud 14 of the header 10 is generally parallel to such substrate. Typically, although not necessarily, the shroud 14 of the header 10 also has walls 18 that extend away from the base 16 at generally right angles thereto. Accordingly, the walls 18 form a well within which the electrical connector 12 is inserted while mating to the header 10. Typically, the walls 18 align and guide the electrical connector 12 as it is being inserted so as to ensure a proper connection and so as to prevent damage that may occur from mis-alignment. The walls 18 may include one or more keying elements that mate to corresponding keying elements in the electrical connector 12 to further ensure a proper connection and for polarization.

As shown in FIG. 1, header 10 includes a plurality of contacts 20 arranged into rows and columns (various of the contacts 20 are omitted in FIG. 1 for the sake of clarity only). The contacts 20 include signal contacts and ground contacts, and can have any particular arrangement or orientation without departing from the spirit and scope of the present invention. For one example, in a differential pair application, each row may have seven contacts 20 (as shown), and such contacts 20 are, from one end to the other, a ground contact 20, a first pair of differential signal contacts 20, a second ground contact 20, a second pair of differential signal contacts 20, and a third ground contact 20. For another example, in a single signal application where each signal contact 20 is individually shielded, each row may have seven contacts 20 (as shown), and such contacts 20 are, from one end to the other, a first ground contact 20, a first signal contact 20, a second ground contact 20, a second signal contact 20, a third ground contact 20, a third signal contact 20, and a fourth ground contact 20. Alternatively, and depending on the particular application, each contact 20 may represent a distinct signal, or the contacts 10 in a row may be grouped into arbitrary combinations.

Thus, the connector 12 can also be configured to handle multiple single-ended signal paths where the return path needs to be in close proximity to the signal path. Note that under certain circumstances, a return path of a substantially different length than the signal path will cause additional noise in a condition known as 'Ground Bounce'.

As seen, each contact 20 is mounted to the base 16 of the shroud 14, and extends away from the base 16 from both sides thereof in opposing directions generally perpendicular to such base 16. As also seen, each contact 20 is a pin-type contact, and thus has a pin-shaped appearance as such contact 20 extends between the walls 18 and toward an inserting connector 12. Thus, the header 10 may be mounted to through-holes in the substrate by an appropriate mounting method. Alternatively, the header 10 may be surface-mounted to the substrate (not shown), in which case each contact 20 extends away from the base 16 toward the connector 12 only. Note that a plurality of headers 10 may be mounted in a line on the substrate to form a header assembly (not shown) that receives a plurality of connectors 12.

The connector 12 has a substrate face 22 at which the connector 12 is appropriately mated to a circuit substrate (not shown), and a header face 24 at which the connector 12 receives the contacts 20 of the header 10 when being inserted thereinto. As seen in FIG. 1 and also in FIGS. 2A–2D, the substrate face 22 is generally opposite the header face 24, and the connector 12 is therefore a vertical connector. As shown in FIGS. 1 and 2A–2D, the connector 12 is complementary to the header 10 of FIG. 1 and thus includes a plurality of contacts 26 arranged into rows 27 and columns that correspond to the rows and columns of the header 10 (various of the contacts 26 are omitted in FIG. 1 for the sake of clarity only).

Figure 3:
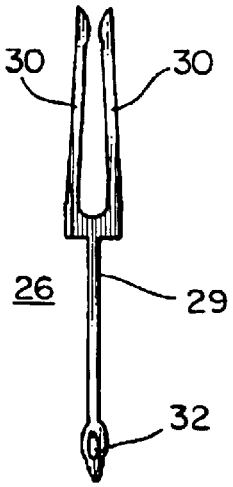
FIG. 3 is a tuning-fork-type contact employed in the connector of FIGS. 1 and 2A–2D.
Figure 6A:
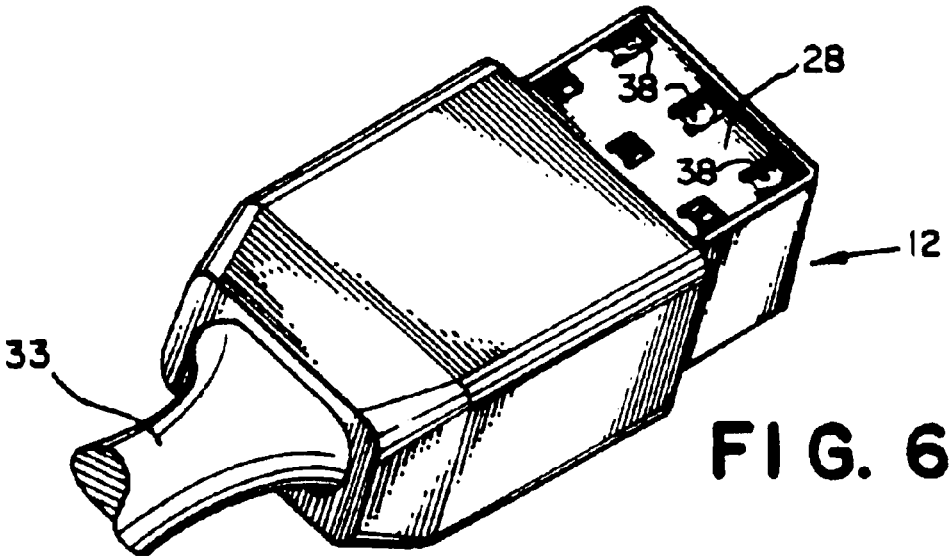
FIG. 6A is a perspective view of an alternate embodiment of the connector of FIGS. 1 and 2A–2D, and shows the connector with an attached cable.
Figure 6C:
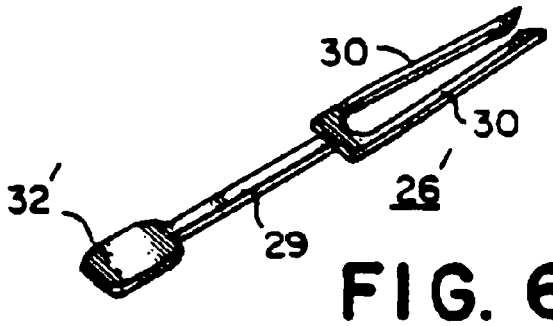
FIG. 6C is a perspective view of a tuning-fork-type contact employed in the row unit of FIG. 6B.
Figure 6B:
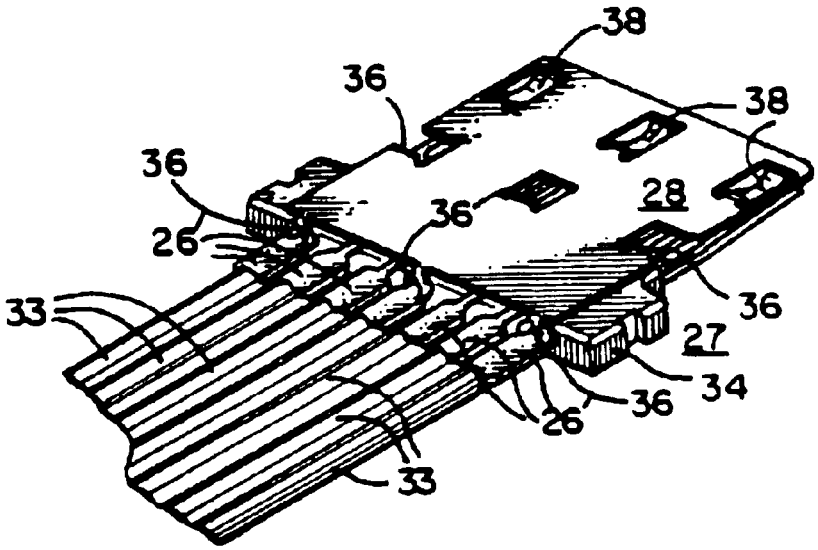
FIG. 6B is a perspective view of a row unit employed in the connector of FIG. 6A.

As best seen in FIG. 3, each contact 26 is in one embodiment of the present invention a tuning-fork-type contact that extends generally longitudinally and that includes a shank 29 at a distal end and a pair of tines 30 at a proximal end in between which is inserted a corresponding pin contact 20 of the header 10 when the connector 12 is mounted thereto. As shown, the tines 30 may be slightly inclined toward each other, and in any event such tines are resiliently springed such that the tines 30 securely grasp the inserted pin contact 20 therebetween and such that the tines spring toward each other when the inserted pin contact 20 is removed. If the connector 12 is to be mounted to a substrate by through-holes thereon (not shown), each tuning-fork contact 26 includes at the end of the shank 29 a pliant portion 32 which when inserted into such a through-hole may be expected to maintain an interference fir therein. Alternatively, and as seen in FIG. 6C, if the connector 12 includes an attached cable (FIG. 6A), each tuning-fork contact 26' includes at the end of the shank 29 a pad 32' which can accept a wire 33 connected thereto by solder or another appropriate mechanism such as an insulation displacing contact, etc. It should be apparent that the contact 26 of FIG. 3 may be substituted with contact 26' of FIG. 6C as necessary, the difference between the FIG. 3 and FIG. 6C contact embodiments being the formation of the ends (32 or 32') as needed. Returning to FIGS. 6A–C, wires 33 may be gathered into a ribbon (FIG. 6B) corresponding to each row 27, and/or may be bound into a cable (FIG. 6A) corresponding to the connector 12. Also alternatively, the pliant portion 32 or pad 32' of FIGS. 3 and 6C respectively may be replaced by a solder tail or the like (not shown). Such contact 26 or 26' as described and shown in FIG. 3 or 6C respectively may be formed from any appropriate material by any appropriate forming process without departing from the spirit and scope of the present invention. For example, the contact 26 may be cut and/or stamped from a sheet of a copper or a copper alloy.

Turning now to FIGS. 4A–4D, it is seen that each row 27 of contacts 26 is constructed as a subassembly that is mounted to the connector 12 during formation thereof. In particular, the row 27 includes the contacts 26 and a row block 34 that securely holds each contact 26 in the row 27 in an appropriate position in relation to the other contacts 26, the connector 12, and the header 10. As seen, the contacts 26 are securely held to the row block 34 by being partially embedded therein. Therefore, the contacts 26 may be in situ over-molded with the row block 34 during formation thereof, and such row block 34 may be formed from a moldable material such as a plastic, polymer, and/or elastomer. Alternatively, the row block 34 may be molded separately and have the contacts 26 inserted thereinto. Of course, other holding mechanisms for holding the contacts 26 in the row 27, other forming mechanisms for forming the holding mechanism, and other forming materials may be employed without departing from the spirit and scope of the present invention.

Figure 4A:
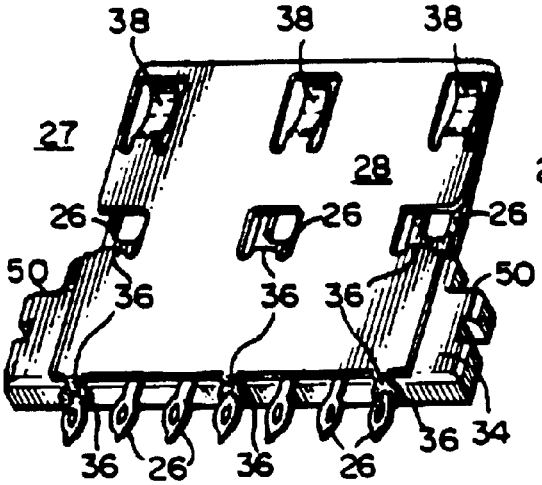
FIGS. 4A–4D are perspective, rear plan, left side plan, and front plan views, respectively, of a row unit having a plurality of the connectors of FIG. 3 for being employed within the connector of FIGS. 1 and 2A–2D in accordance with one embodiment of the present invention.
Figure 4B:
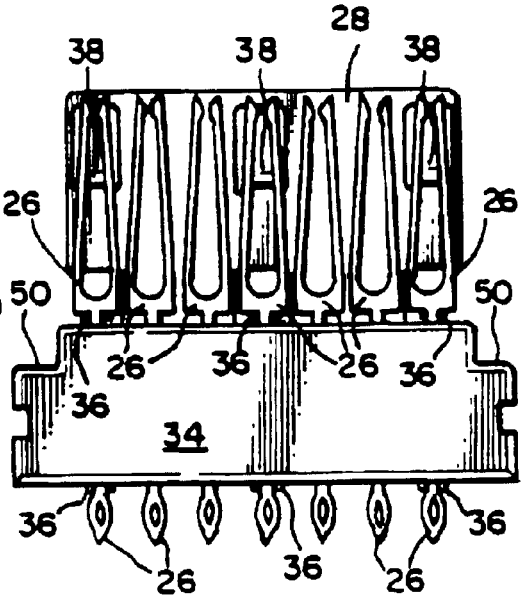

As best seen in FIG. 4B, the row block 34 as formed exposes and does not interfere with the tines 30 of the contacts 26 embedded therein, and also exposes and does not interfere with the pliant portion 32 at the distal end of the shank 29 of each contact 26 embedded therein. In particular, the row block 34 generally covers a longitudinal portion of each contact 26 that extends between the pliant portion 32 and the tines 30, and that generally corresponds to the shank 29 of each contact 26. However, the row block 34 also exposes at least a minimal longitudinal portion of the shank 29 of each contact 26 adjacent each of the pliant portion 32 and the tines 30, the purpose of which is set forth below.

In one embodiment of the present invention, and as best seen in FIGS. 4A–4D, each row 27 of contacts 26 in the connector 12 includes a row shield 28 and thus is divided from a row 27 of contacts 26 opposite the row shield 28. Thus, each row 27 of contacts 26 within the connector 12 is protected from external noise and/or cross-talk from adjacent row(s) 27 of contacts 26 by the row shields 28. Moreover, if a plurality of connectors 12 are mounted in a line on the circuit board to form a connector assembly (not shown) corresponding to the aforementioned header assembly, the connectors 12 are preferably arranged such that adjacent connectors 12 are divided by a row shield 28 in one of the adjacent connectors 12.

As shown, for each row 27, the row shield 28 therefor extends laterally substantially between the outside edges of the outside contacts 26 in the row 27, and also extends longitudinally substantially from the tips of the tines 30 to the junctures of the pliant portions 32 and the shanks 29 of the contacts 26 in the row 27. Thus, every contact 26 in the row 27 is substantially completely physically separated from every contact 26 in an adjacent row 27 by the row shield 28, excepting of course at the pliant portions 32.

In one embodiment of the present invention, the row shield 28 as formed is generally planar but includes clips 36 that extend generally normal to the planar extent of the row shield 28. As best seen in FIG. 4A, such clips 36, which may be integral with the remainder of the row shield 28, are positioned to clip on to various of the contacts 26 on the row 27. Of course, it should be appreciated that, absent any insulative barrier, clipping the row shield 28 to a contact 26 by way of a clip 36 thereof electrically couples the row shield 28 to the contact 26. Thus, clipping to multiple contacts 26 shorts out same. As a result, the row shield 28 should be clipped to ground contacts 26 only. Note that each row shield 28 may act as a return path for electrical currents in the case of single ended signaling.

In one embodiment of the present invention, for each contact 26 that the row shield 28 is clipped to, the row shield 28 includes a corresponding pair of clips 36. In particular, and as may be seen in FIGS. 4B and 4D, each pair of clips 36 includes an upper clip 36 that clips to the minimal longitudinal portion of the shank 29 of the contact 26 on the one side of the row block 34 adjacent the tines 30, and a lower clip 36 that clips to the minimal longitudinal portion of the shank 29 of the contact 26 on the other side of the row block 34 adjacent the pliant portion 32 of the contact 26. Thus, the clips 36 and the row shield 28 attach to the row 27 of contacts 26 so as to straddle the row block 34 of such row 27. Each clip 36 should be sized to securely grasp the shank 29 of the contact 26. Each clip 36 may be attached to such shank 29, then, by appropriately positioning the row shield 28 with respect to the row 27 of contacts, and then applying pressure to each clip 36 to engage such clip 36 and the row shield 28 to a respective contact 26 at a respective shank 29 thereof.

Figure 4C:
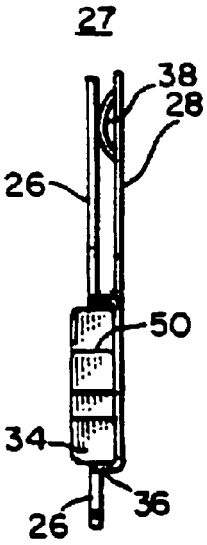

In one embodiment of the present invention, for each contact 26 that the row shield 28 is clipped to, the row shield 28 also includes a corresponding beam 38 for electrically engaging the contact 26 at the tines 30 thereof. As best seen in FIG. 4C, the beam 38 is cantilevered and protrudes from the general planar extent of the remainder of the row shield 28 toward the tines 30 to engage same, and may in fact comprise a bowed portion of the row shield 28 at an appropriate location thereon. The beam 38, which as shown extends longitudinally with respect to the contact 26 and tines 30 thereof, may be detached from the remainder of the row shield 28 at lateral sides thereof and at an upper or lower longitudinal end thereof, the upper being shown as detached in FIGS. 4A and 4D in particular.

The beam 38 is not absolutely necessary for providing electrical engagement with the corresponding contact 26, especially inasmuch as the row shield 28 also contacts the contact 26 of the beam 38 by way of the clips 36. However, and importantly, the beam directly engages the contact 20 of the header 10 corresponding to the contact 26 of the connector 12 when such contact 20 engages such contact 26, assuming the engaging contact 20 of the header 10 is wide enough to protrude toward and engage such beam 38. If in fact the engaging contact 20 of the header 10 is wide enough, such contact 20 in engaging such beam 38 causes flexure thereof away from the contact 26 of the connector 12. In any event, and as may be appreciated, such direct contact between the beam 28 and the contact 20 of the header 10 increases the effectiveness of the row shield 28 in shielding the signal contacts 20 in the header 10 and the signal contacts 26 in the connector 12.

Such row shield 28 with clips 36 and beams 38 may be formed from any appropriate material by any appropriate forming process without departing from the spirit and scope of the present invention. For example, the row shield 28 may be cut, stamped, and/or bent from a sheet of a copper or a copper alloy.

With a plurality of rows 27, where each row 27 includes contacts 26 arranged within a row block 34 and a row shield 28 coupled to one or more of the contacts 26 in the row 27 as seen in FIGS. 4A–4D, a number of the rows 27 are inserted within a housing 40 as shown in FIGS. 5A–5D to form the connector 12. In particular, and as may be appreciated from appropriately juxtaposing FIGS. 4A and 5A, the housing has a number of row sections 42 (six are shown) corresponding to the number of rows 27 in the connector 12 and header 10, where each row section 42 includes space for a row 27 and the contacts 26 and row shield 28 thereof. Thus, for each row section 42, a row 27 is inserted tines 30 first into such row section 42 such that the row block 34 and pliant portions 32 remain exterior to the row section 42 and housing 40, as is seen in FIG. 1.

The inserted row 27 may remain securely inserted into the housing 40 by any appropriate mechanism without departing from the spirit and scope of the present invention. For example, each contact 26 and/or the row shield 28 of the row 27 may maintain an interference fit with the housing. Additionally or alternatively, each contact 26 and/or the row shield 28 of the row 27 may include one-way barbs (not shown) that allow insertion but prevent retraction.

Referring again to FIGS. 5A–5D, it is seen that in each row section 42 of the housing 40, a chamber 44*s*, 44*g* is defined for each contact 26 of the inserted row 27, and a chamber 44*r* is defined for the row shield 28 of the inserted row 27. In particular, it is seen that each chamber 44*s* which is defined for a signal contact 26 isolates such inserted signal contact 26 from the row shield 28 of the row 27 in the chamber 44*r*. In contrast, each chamber 44*g* which is defined for a ground contact 26 does not isolate such inserted ground contact 26 from the row shield 28 of the row 27 in the chamber 44*r*. Thus, and as may be appreciated, each chamber 44*g* opens to the chamber 44*r* and allows the ground contact 26 inserted into such chamber 44*g* to be contacted by the corresponding beam 38 of the row shield 28 in the chamber 44*r*. However, each chamber 44*s* does not open to the chamber 44*r* and thus does not allow the signal contact 26 inserted into such chamber 44*s* to be contacted by any portion of the row shield 28 in the chamber 44*r*.

Figure 5A:
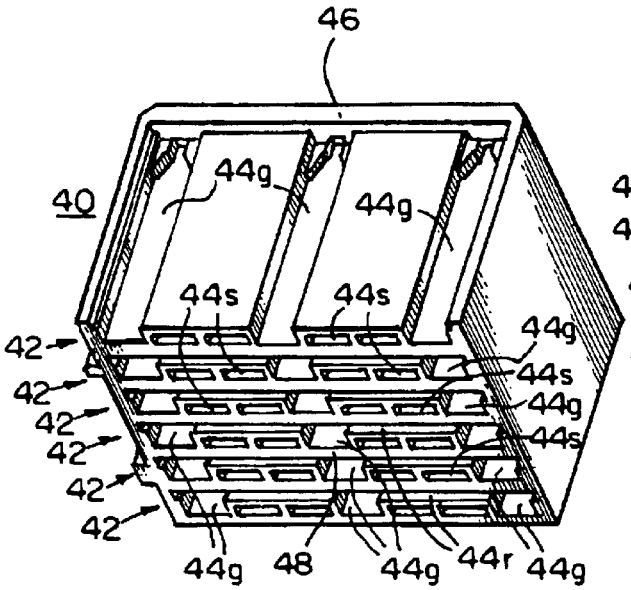
FIGS. 5A–5D are perspective, top plan, front plan, and bottom plan views, respectively, of a housing for receiving multiple ones of the row unit of FIGS. 4A–4D to form the connector of FIGS. 1 and 2A–2D in accordance with one embodiment of the present invention.
Figure 5B:
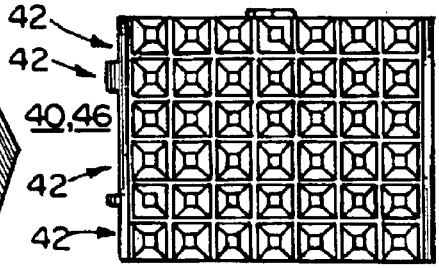
Figure 5C:
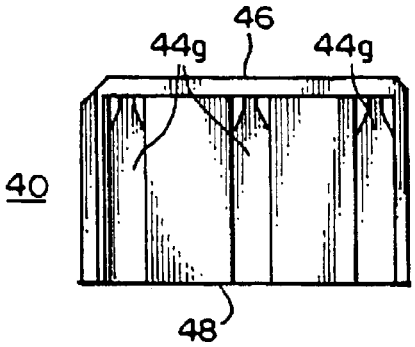
Figure 5D:
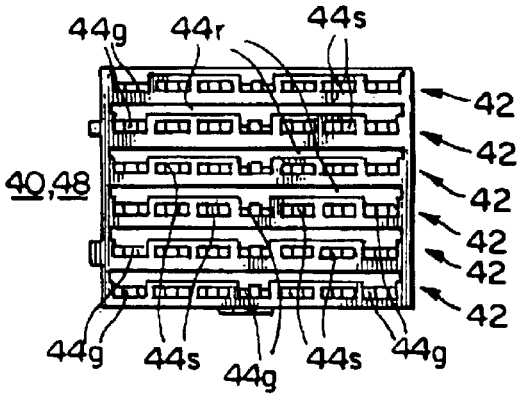

Note that each chamber 44*s*, 44*g*, which receives a signal contact 26 or ground contact 26, respectively, has an opening at a top face 46 of the housing 40. As best seen in FIGS. 5A–5D, where such top face 46 is opposite a bottom face 48 through which each row 27 is inserted into such housing 40. Note also that such opening allows each contact 20 in the header 10 to be inserted into the housing 40/connector 12 and into engagement with a respective contact 26 in the connector 12. As seen in FIG. 5B in particular, each opening at the top face 46 may be surrounded by beveled surfaces that guide a respective contact 20 of the header 10 toward and through such opening. Particularly with regard to the tuning-fork-type contacts 26 of the connector, each opening also ensures that a respective guided contact 20 engages a respective contact 26 between the tines 30 thereof.

Figure 4D:
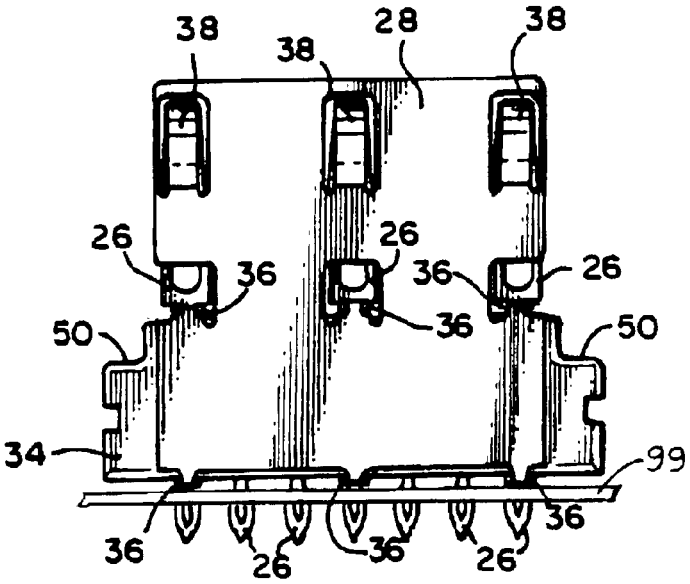

As may be appreciated from FIG. 1 especially, in the course of inserting a row 27 into a row section 42, the row block 34 thereof essentially butts up to the bottom face 48 of the housing 40. Thus, the row blocks 34 of the connector 12 in combination form a bottom part of the connector 12, at least facially, while the housing 40 of the connector 12 forms an upper part of the connector 12, again at least facially. In one embodiment of the present invention, and as seen in FIGS. 1, 2B, 4A, 4B, and 4D, the row blocks 34 of the connector 12 are each provided with a pair of opposing pressing shoulders 50 that are accessible from above the row 27. As may be appreciated, if the connector 12 is to be press-fitted into an underlying substrate 99, as shown in FIG. 4D, pressure may be applied on the pressing shoulders 50 in the course of such press-fitting. Correspondingly, pressure need not be applied directly to the housing 40.

The housing 40 may be formed from any appropriate material by any appropriate forming process without departing from the spirit and scope of the present invention. For example, the housing 40 may be molded from a plastic, polymer, and/or elastomer. Of course, other holding mechanisms for holding the rows 27, other forming mechanisms for forming the housing 40, and other forming materials may be employed without departing from the spirit and scope of the present invention.

In the foregoing description, it can be seen that the present invention comprises a new and useful connector 12 that can have signals such as multiple differential signal pairs in relatively high density, and that has shielding for the signal pins, where the connector is practical and relatively easily manufactured. It should be appreciated by those skilled in the art that changes could be made to the embodiments described above without departing from the inventive concepts thereof. Significantly, the present invention is not limited to differential signal pairs, but can embody any type of signals, including but not limited to high speed signals, low speed signals, differential signals, single ended signals, and the like. It is understood, therefore, that this invention is not limited to the particular embodiments disclosed, but it is intended to cover modifications within the spirit and scope of the present invention as defined by the appended claims.

What is claimed is:

1. A connector for mating to a header having a plurality of header contacts arranged into a plurality of header rows, the header contacts in each header row including signal contacts and ground contacts in a pre-determined arrangement, the connector being complementary to the header and comprising:

a housing;

a connector row corresponding to each header row, each connector row being constructed as a subassembly that is mounted to the housing to form the connector, the connector row comprising:

a plurality of connector contacts, each connector contact corresponding to a header contact;

a row block securely holding each connector contact in the connector row; and a row shield for electrically shielding the connector contacts of the connector row from an adjacent connector row, wherein the row shield is generally planar and includes at least one clip that extends generally normal thereto, each clip being positioned on the row shield to couple to a connector contact on the connector row, the clips thereby securing the row shield to the connector row.

2. The connector of claim 1 wherein each clip is positioned on the row shield to couple to a connector contact on the connector row corresponding to a ground contact of the header contacts.

3. The connector of claim 1 wherein each connector contact includes a shank and wherein the row shield includes a pair of clips for each coupled-to connector contact, the pair of clips coupling to the shank of the connector contact on opposite sides of the row block.

4. A connector for mating to a header having a plurality of header contacts arranged into a plurality of header rows, the header contacts in each header row including signal contacts and around contacts in a pre-determined arrangement, the connector being complementary to the header and comprising:

a housing;

a connector row corresponding to each header row, each connector row being constructed as a subassembly that is mounted to the housing to form the connector and having:

a plurality of connector contacts, each connector contact corresponding to a header contact;

a row block securely holding each connector contact in the connector row; and a row shield for electrically shielding the connector contacts of the connector row from an adjacent connector row;

wherein the housing has a row section corresponding to each connector row in the connector, each row section including space for the connector contacts and row shield of the connector row, and wherein each connector contact has a proximal end at which a corresponding header contact is to be contacted when the connector is mated to the header, and wherein a connector row is inserted into each row section such that the proximal ends of the connector contacts of such connector row are received first.

5. A connector for mating to a header having a plurality of header contacts arranged into a plurality of header rows, the header contacts in each header row including signal contacts and around contacts in a pre-determined arrangement, the connector being complementary to the header and comprising:

a housing;

a connector row corresponding to each header row, each connector row being constructed as a subassembly that is mounted to the housing to form the connector and having:

a plurality of connector contacts, each connector contact corresponding to a header contact;

a row block securely holding each connector contact in the connector row; and a row shield for electrically shielding the connector contacts of the connector row from an adjacent connector row; wherein the housing has a row section corresponding to each connector row in the connector, each row section including space for the connector contacts and row shield of the connector row; wherein a connector row is inserted into each row section such that the row block of such connector row remains exterior to the row section and housing.

6. A connector for mating to a header having a plurality of header contacts arranged into a plurality of header rows, the header contacts in each header row including signal contacts and around contacts in a pre-determined arrangement, the connector being complementary to the header and comprising:

a housing;

a connector row corresponding to each header row, each connector row being constructed as a subassembly that is mounted to the housing to form the connector and having:

a plurality of connector contacts, each connector contact corresponding to a header contact;

a row block securely holding each connector contact in the connector row; and a row shield for electrically shielding the connector contacts of the connector, row from an adjacent connector row; wherein the housing has a row section corresponding to each connector row in the connector, each row section including space for the connector contacts and row shield of the connector row; wherein each connector contact has a distal end at which such connector contact is to be mounted to a substrate, and wherein a connector row is inserted into each row section such that the distal ends of the connector contacts of such connector row remain exterior to the row section and housing.

7. A connector for mating to a header having a plurality of header contacts arranged into a plurality of header rows, the header contacts in each header row including signal contacts and around contacts in a pre-determined arrangement, the connector being complementary to the header and comprising:

a housing;

a connector row corresponding to each header row, each connector row being constructed as a sub assembly that is mounted to the housing to form the connector and having:

a plurality of connector contacts, each connector contact corresponding to a header contact;

a row block securely holding each connector contact in the connector row; and a row shield for electrically shielding the connector contacts of the connector row from an adjacent connector row; wherein the housing has a row section corresponding to each connector row in the connector, each row section including space for the connector contacts and row shield of the connector row; wherein each row section defines a chamber for each connector contact of the inserted connector row and a chamber for the row shield of the inserted connector row, wherein within each row section, each chamber for a connector contact corresponding to a signal contact of the header contacts is isolated from the chamber for the row shield, and wherein within each row section, each chamber for a connector contact corresponding to a ground contact of the header contacts opens to the chamber for the row shield and allows such ground contact to be contacted by the row shield when the connector is mated to the header.

* * * * *